United States Patent [19]

Steinecker

[11] 4,229,267

[45] Oct. 21, 1980

[54] ALKALINE BRIGHT ZINC PLATING AND ADDITIVE THEREFOR

[75] Inventor: Carl Steinecker, Milford, Mich.

[73] Assignee: Richardson Chemical Company, Des Plaines, Ill.

[21] Appl. No.: 44,683

[22] Filed: Jun. 1, 1979

[51] Int. Cl.[2] ..... C25D 3/22; C25D 3/24

[52] U.S. Cl. ..... 204/55 R; 204/55 Y; 204/DIG. 2; 525/336; 526/307

[58] Field of Search ..... 204/55 R, 55 Y, 52 Y, 204/DIG. 2; 525/336; 526/307

[56] References Cited

U.S. PATENT DOCUMENTS

| | | | |
|---|---|---|---|
| 3,393,135 | 7/1968 | Rosenberg | 204/55 Y |
| 3,734,839 | 5/1973 | Hoyer et al. | 204/55 Y |
| 3,790,529 | 2/1974 | Fujimura et al. | 529/486 |
| 3,853,718 | 12/1974 | Creutz | 204/55 R |
| 3,907,758 | 9/1975 | Sackmann | 525/329 |
| 3,972,789 | 8/1976 | Eppensteiner et al. | 204/55 Y |
| 4,081,336 | 3/1978 | Eppensteiner et al. | 204/55 Y |

FOREIGN PATENT DOCUMENTS

| | | | |
|---|---|---|---|
| 887900 | 1/1962 | United Kingdom | 526/307 |

*Primary Examiner*—F. C. Edmundson

*Attorney, Agent, or Firm*—Lockwood, Dewey, Alex & Cummings

[57] ABSTRACT

An alkaline, electroplating bath for bright zinc plating comprising a source of zinc ions and a bath soluble polymer containing repeating tertiaryaminoalkyl acrylamide groups or quaternary salts thereof. The bath is capable of producing bright, fine grained zinc deposits over a broad current density range both in the presence and absence of cyanides.

23 Claims, No Drawings

ALKALINE BRIGHT ZINC PLATING AND ADDITIVE THEREFOR

BACKGROUND AND DESCRIPTION OF THE INVENTION

The present invention generally relates to bright zinc electroplating and, more particularly, to electroplating baths for zinc plating which include bath soluble polymers containing repeating tertiaryaminoalkyl acrylamide groups, or quaternary salts thereof, which produce bright, zinc electrodeposits and which, moreover, permit the plating to be conducted with various concentrations of cyanide salts or even desirably in the total absence of said salts.

Conventionally, zinc electroplating has been conducted in plating baths employing alkali metal cyanide salts such as, for example, sodium cyanide which serves in such baths as an additive or complexing agent to achieve the desired plating operation and produce bright, smooth grained, zinc deposits.

Quite often, the brightness and/or grain of the electrodeposit is not entirely suitable for many plating applications and, accordingly, various additives such as brighteners or grain refiners have been required in the bath in order to enhance the plating. Such additives have not, however, always been effective in their intended use, and typically have also required high levels of cyanide in order to achieve the desired plating. Moreover, because of the toxicity of cyanides and, more recently, by reason of the environmental considerations adversely affecting the economic employment of these cyanides, other plating methods have been sought which operate effectively either at a low cyanide level or advantageously in the total absence of cyanide salts.

Heretofore, a wide variety of procedures and additives have been proposed for use in zinc plating for the purpose of eliminating the need for cyanides or at least lessening the concentration thereof required. Many of these additives employ an alkaline plating bath system utilizing an alkali metal or sodium zincate combined with various additives such as polyamines to achieve the desired bright zinc deposit and a smooth or fine grained, mirror-like surface.

While certain of these alkaline systems do avoid the use of cyanides or at least high bath concentrations of cyanide, they generally have not been overly successful, and the zinc electrodeposits typically produced have been characterized by a number of deficiencies such as a dull or granular finish which render them of less than acceptable commercial value. Such systems, moreover, typically lack the desired capability of producing a suitable smooth, mirror-like deposit over a broad current density range and generally are especially ineffective at lower current density ranges which conventionally occur in many commercial plating operations.

It has now been discovered that bath soluble polymers containing repeating tertiaryaminoalkyl acryamide groups, or quaternary salts thereof, may be employed in alkaline zinc electroplating baths to produce fine grained, bright zinc deposits over a broad current density range both in the presence and absence of cyanide salts. In this regard, it has also been discovered that the effectiveness of such polymers can be enhanced using, in conjunction therewith, certain polyethylenepolyamines, particularly those formed by reacting ammonia with ethylene dichloride, or quaternary salts thereof.

It is, therefore, a general object of the present invention to provide an alkaline, zinc electroplating bath which achieves bright zinc deposits either with various concentrations of cyanide salts or in the absence thereof.

Another object of the present invention is to provide an improved alkaline, zinc or electroplating bath additive composition which is particularly suited for cyanide zinc barrel plating operations and which is characterized by improved throwing power at high cathode efficiencies and produces brilliant deposits over a wide current density range.

Another object of the present invention is to provide an alkaline, zinc electroplating bath which employs a bath soluble polymer containing repeating tertiaryaminoalkyl acrylamide groups.

Another object of the present invention is to provide an alkaline, zinc electroplating bath which employs a bath soluble polymer containing repeating quaternaryaminoalkyl acrylamide groups.

Another object of the present invention is to provide an alkaline, zinc electroplating bath which employs a bath soluble polymer containing repeating tertiary or quaternary-aminoalkyl acrylamide groups in admixture with a polyethylene-polyamine such as, for example, one prepared by reacting ammonia with ethylene dichloride, or a quaternary salt thereof.

Another object of the present invention is to employ such polymers which contain repeating tertiary or quaternary-aminoalkyl acrylamide groups with other conventional plating additives such as brightening agents and grain refiners to achieve bright, mirror-like zinc deposits over a broad current density range.

Another object of the present invention is to provide a method of zinc electroplating employing such improved bath which is capable of effectively operating in a commercially desirable manner both with and without cyanide salts.

These and other objects of the present invention will be apparent from the following further detailed description thereof.

In accordance with an important aspect of the present invention, the electroplating of zinc is conducted in a bath containing a suitable source of zinc ion to which the bath soluble polymer containing repeating tertiary or quaternary—aminoalkyl acrylamide groups is added. Preferably, certain polyethylenepolyamines, or quaternary salts thereof, are also added in conjunction with other plating additives including condensates of epihalodrins and heterocyclic compounds such as nicotinamide or quaternary salts of such condensates and alkali metal carbonates such as sodium carbonate.

The bath soluble polymer containing repeating tertiary or quaternary—aminoalkyl acrylamide groups may be produced by polymerization of tertiary or quaternary—aminoalkyl acrylamide monomer in the presence of a suitable catalyst such as, for example, ammonium persulfate. Typically, the polymerization reaction may be conducted by adding about one liter of water to a vessel containing about 500 grams of the monomer followed by the addition of about one-half gram of catalyst while moderately agitating the mixture. The reaction temperature employed may be varied depending upon the particular monomer utilized but usually ranges from above about 50° C. to about 90° C. The duration of the condensation reaction may also be varied and likewise in a function of the specific reactants and temperatures employed. Usually, however, the reaction period ranges from about two to about four hours. Upon completion of the polymerization reaction, the mixture can be cooled to room temperature and the polymer recovered by conventional separational techniques such as distillation and/or filtration. If desired, however, the polymer need not be separated from the mixture and the final reaction mixture containing the polymer product may be directly employed as an additive to the zinc plating bath.

The tertiary amino form of the polymer precursor may generally be characterized by the following structural formular:

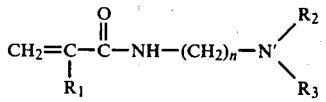

wherein $R_1$ is H or methyl; n is an integer from 2 to 6; and $R_2$ and $R_3$ are alike or different and are lower alkyl groups containing 1 to 4 carbon atoms. Illustrative examples of such tertiaryaminoalkyl acrylamides as well as an appropriate manner for the preparation thereof are contained in U.S. Pat. No. 3,878,247, entitled "Preparation of N—(tertiaryaminoalkyl) acrylamides", the disclosure of which is incorporated herein by reference.

Preferably, the quaternary-amino form of the polymer precursor is employed and can be prepared by quaternization of the tertiaryaminoalkyl acrylamide in a known manner, such as, for example, by the reaction thereof with methyl chloride. The quaternization reaction can be performed in an aqueous alkaline media. A small amount of catalyst can be used to initiate the reaction and, for this purpose, any catalyst which is well known in the art may be used, including organic and inorganic types. The reaction is typically carried out at an elevated temperature of up to about 300° F.

The bath soluble reaction product obtained by polymerization of the tertiary-amino monomer forms can generally be characterized by recurring groups of the following structural formula:

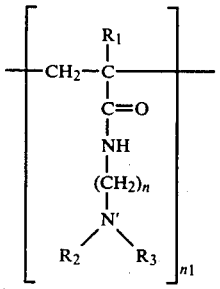

where n, $R_1$, $R_2$ and $R_3$ are as described above and $n_1$ is an integer of from three to twenty. Correspondingly, the preferred bath soluble reaction product formed by polymerization of quaternary-amino monomer forms may generally be characterized by recurring groups of the following structural formula:

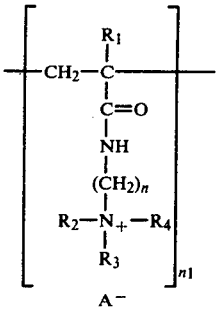

where n, $R_1$, $R_2$ and $R_3$ are as described above, $R_4$ is a lower alkyl group containing 1 to 4 carbon atoms, A is halogen, and $n_1$ is an integer of from three to twenty. In a particularly preferred embodiment of the present invention, $R_1$, $R_2$, $R_3$ and $R_4$ are each methyl, A is chloride, n is 3 and $n_1$ is about ten.

The polyethylenepolyamines contemplated by the present invention are those which are prepared by reacting ammonia with ethylene dichloride. Typically, the ratio of ethylene dichloride to ammonia will usually vary from 6:1 to 2:1 and preferably 4:1. Typically, the polyethylenepolyamine is formed from the reaction of ammonia and ethylene dichloride under conditions of elevated temperatures and pressures. A suitable procedure which can be employed involves the addition of ethylene dichloride into a pressurized system to which anhydrous ammonia is continuously injected at a temperature in the range of from approximately 210° F. to approximately 300° F. and at pressures of 25–75 psi. The pressure in the reaction vessel will increase as the reaction proceeds. As noted, the ratio of ethylene dichloride to anhydrous ammonia will generally be between 6:1 to 2:1 depending upon the other reaction conditions and the molecular weight of the amine that is desired.

Preferably, the polyethylenepolyamine is then quaternized in a known manner such as, for example, by the reaction thereof with methyl chloride. Typically, a concentration ration of polyethylenepolyamine to methyl chloride of from 4:1 to 1:1 can be employed with the preferred ratio being 2:1. This reaction is performed in an aqueous alkaline media and, for this purpose, any alkaline solution may be used, however, sodium hydroxide solution is preferred. The concentration may vary within a wide range but is generally 20–60 percent based on the amine content. A small amount of catalyst can be used to initiate the reaction and, for this purpose, any catalyst which is well known in the art may be used, including organic and inorganic types. The reaction is typically conducted at an elevated temperature of between 175° F. and 300° F. The polyquaternary ammonium salt which is formed is thereby used in this liquid state. Suitable polyethylenepolyamines and quaternary salts thereof which can be employed in the present invention include those which are described in U.S. Pat. No. 3,957,595, the disclosure of which is incorporated herein by reference.

The condensates of epihalohydrins and heterocyclic compounds such as nicotinamide or quaternary salts of such condensates which can be advantageously conjointly used with the above-described bath soluble polymers in the baths of the present invention are generally described in U.S. Pat. No. 3,972,789. As noted therein, the epihalohydrins which may be interreacted with the heterocyclic compound include epichlorohydrin, epibromohydrin or epiiodohydrin with the epichlorohydrin being particularly preferred in most instances. Other halo epoxies or glycerol halohydrins which react in a similar fashion or which form a reaction moiety similar to the epihalohydrin under condensation conditions may also be employed although generally with less desirable results. Such halo epoxides may include halo glycerols such as alpha dichloroglycerol or epoxy alkanes or di-epoxides such as bis-(2,3-epoxypropane) propylene glycol.

The heterocyclic compound and specifically a nitrogen heterocyclic compound which may be reacted with the epihalohydrin to form the condensate includes a heterocyclic, such as pyridine, substituted in the 3 or 4 ring position with a radical selected from the group consisting of amino, carbamoyl or acylhydrazino.

Such pyridine has the following general formula:

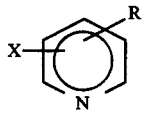

wherein R is a radical selected from the group consisting of amino, ($-NH_2$); carbamoyl,

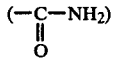

or acylhydrazino,

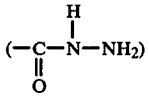

where R is in one of the 3 or 4 ring positions and where X is a radical which does not interfere with the condensation reaction and includes for example lower alkyl of from 1 to 5 carbon atoms, halo such as chloro or bromo; or lower alkoxy of from 1 to about 5 carbon atoms.

Of the various nitrogen heterocyclic compounds which may be employed with the above-described bath soluble polymers of this invention, the pyridines substituted in the 3 ring position are preferred and especially when substituted with carbamoyl to form such compounds as nicotinamide, that is, 3-carbamoyl-pyridine. Other compounds having the above general formula may also be employed and include, for example, such compounds as 4-carbamoyl-pyridine; 3-amino-pyridine; 4-amino-pyridine; 3-acylhydrazino-pyridine; 4-acylhydrazinopyridine; or 3-amino-5-methoxy-pyridine.

In preparing these condensates of the nitrogen heterocyclic and epihalohydrin, the conditions and procedures conventionally employed in condensation reactions between epihalohydrins and cyclic amines may, in most instances, be suitably employed. In general, the heterocyclic and epihalohydrin should be condensed in a mol ratio from about 2:1 to 1:2 mols, respectively. Usually a more limited range is preferred, however, particularly when employing preferred reactants such as epichlorohydrin and a nicotinamide and advantageously the mol ratio of the epihalohydrin to heterocyclic compound ranges from about 1.5:1 to 1:1.5, respectively, or more preferably about 1 to 1, respectively.

Typically, the condensation reaction is conducted by gradually adding the epihalohydrin with stirring to the heterocyclic compound maintained in a suitable reaction medium such as water or aqueous alcohol and then permitting the reaction to proceed to completion. The reaction temperature employed may be varied depending upon the particular reactants utilized but usually ranges from above about 25° C. or 80° C. or 90° C. with the reflux temperature of the mixture in the range of approximately 100° C. being conveniently employed in most instances. The duration of the condensation reaction may also be varied and is a function of the specific reactants and temperatures employed. Usually, however, the reaction period ranges from about 0.5 to 2.0 hours when utilizing such reactants as epichlorohydrin and nicotinamide.

Upon completion of the condensation reaction, the product may, if desired, be separated from the reaction mixture using conventional separational techniques such as distallation and/or filtration to recover the desired product. Conveniently, however, and particularly when employing an aqueous reaction medium the condensation product need not be separated from the reaction mixture and the final reaction mixture containing the condensate product may be directly employed as an additive to the zinc plating bath.

The condensate product obtained in the condensation reaction may generally be characterized as a water soluble polyamide having carbonyl functionality and a macromolecular or polymeric nature. For example, in a condensation employing an epihalohydrin and a heterocyclic such as nicotinamide the condensate product, in simplest illustrative form may be characterized by the following basic repeating unit.

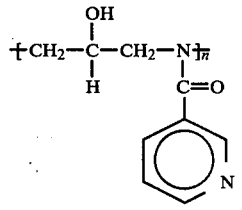

where n ranges from about 1.5 to 30 or more and usually corresponds to a molecular weight of from about 400 to 9,000 or more, preferably from about 200 to 3,000. Such condensate product is crystalline in nature, highly hygroscopic and generally absorbs moisture quickly and dissolves with the general characteristics of a polyelectrolyte. Such condensate moreover is highly water soluble and generally quite stable in highly alkaline media thus rendering such condensate particularly suitable for employment in bright zinc electroplating baths.

The polymeric condensate may also be employed in the zinc electroplating bath of this invention in the form of a quaternary salt. In general, these quaternary salts may be prepared by quaternizing the condensate of the heterocyclic compound and epihalohydrin as prepared according to the procedures described above by further reacting the condensate thus prepared with a suitable quaternizing agent. Typically the condensate in the form of a quaternary salt may be represented in an illustrative structure which corresponds to the structure above for the condensate of epichlorohydrin and nicotinamide as follows:

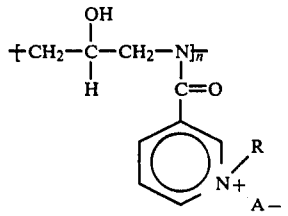

where R is the quaternizing group of the quaternizing agent and A is mono or polyvalent anion derived from the quaternizing agent.

Suitable quaternizing agents for reaction with the condensate include the lower alkyl or alkenyl halides such as methylchloride, -bromide, or -iodide; ethylchloride, -bromide, or iodide; or alpha chloroglycerol; diloweralkyl sulfates such as dimethyl-, diethyl-, dipropyl-, or dibutyl-sulfates; aralkyl halides such as benzyl chloride; lower alkyl esters of aryl sulfonates such as methyl toluene sulfonate and methyl benzene sulfonate; alkylhalo esters such as ethyl-chloroacetate; alkylene halohydrins such as ethylenechlorohydrin or alkylene oxides such as ethylene oxide or propylene oxide; alpha halo acetic acid derivatives, for example, alpha chloro ethyl acetate, alpha chloro acetamide, alpha chloro sodium acetate; haloketones such as chloroacetone; lactones, for example, propiolactone or sultones such as propane sultone.

The quaternization of the condensate of the heterocyclic compound and the epihalohydrin such as nictoinamide and epihalohydrin for use in accordance with this invention may be effected according to conventional procedures. In general, the condensate is reacted with the desired quaternizing agent at a temperature of from about 25° to about 75° C. and for a few minutes to several hours in a suitable reaction medium. Advantageously such reaction medium may be the final reaction mixture of the condensation reaction and the desired quantity of the quaternizing agent may be directly added to such mixture to effect the desired quaternization of the condensate. Generally, the desired quaternizing agent should be added to the condensate in a ratio of from about 0.5 to 1.0 mols of quaternizing agent per mol of condensate with about 1 mol being preferred in most instances. After the reaction is completed, the quaternary salt may, if desired, be recovered from the reaction mixture utilizing suitable separating techniques. However, as with the condensate, the water soluble quaternary salt need not be separated from the reaction mixture and may conveniently be directly added to the zinc plating bath while still contained in the reaction mixture.

The electroplating bath of this invention may be prepared and operated in accordance with the general procedures conventionally employed for alkaline, bright zinc plating. Typically, the bath is prepared as an aqueous solution and rendered alkaline by the addition of a suitable alkaline material such as alkali metal hydroxide, for example sodium or potassium hydroxide. The bath soluble polymer containing repeating tertiary and/or quaternary-aminoalkyl acrylamide groups can then be added, usually in the form of an aqueous concentrate. The quantity of alkaline material added should be capable of dissolving the zinc compound employed as the source of zinc ion in the bath and generally should be in excess of that required to create in certain baths a desired alkali metal zincate such as sodium zincate as well as to maintain the pH of the solution alkaline and generally 12 and above which corresponds to a sodium hydroxide concentration of from about 50 to 150 grams per liter.

The source of the zinc ion in the bath can be varied and generally any kind of zinc compounds conventionally employed in alkaline bright zinc baths may be utilized. Typically, such compounds include water soluble or aqueous alkaline soluble, zinc salts or oxides such as zinc sulfate, zinc acetate, or zinc oxide with the zinc sulfate generally being preferred for cyanide-free baths and zinc oxide for cyanide containing baths. The amount of zinc in the bath can be varied depending upon the desired results and operating conditions but is usually maintained within the range of from about 1 to about 55 grams per liter with a more limited range of about 3 to 35 grams per liter being more typical.

The amount of bath soluble polymer containing repeating tertiary and/or quaternary-aminoalkyl acrylamide groups utilized in the bath of this invention will generally be a function of the particular bath soluble polymer employed as well as a function of whether the bath is operated with or free of cyanides. Typically, however, the quantity of such polymer in the bath will range from about 0.05 to about 1.0 grams per liter with a more limited range of from about 0.10 to about 0.20 grams per liter being preferred.

The quantity of polyethylenepolyamine utilized in the bath will, in general, be a function of the particular bath soluble polymer employed as well as the particular polyethylenepolyamine employed and whether such polyethylenepolyamine has been quaternized. Typically, however, when employing quaternized polyethylenepolyamines formed from a reaction mixture wherein the ratio of ethylene dichloride to ammonia is approximately 4:1 which reaction product is then quaternized with methyl chloride in a reaction mixture wherein the ratio of polyethylenepolyamine to methyl chloride is approximately 2:1, the quantity of such polyethylenepolyamine in the bath should range from about 0.25 to about 5 grams per liter with a more limited range of from about 0.3 to about 0.75 grams per liter being preferred. Correspondingly, when employing a tertiary polyethylenepolyamine formed from a similar reaction mixture of ethylene dichloride and ammonia, the quantity of such polyethylenepolyamine will range from about 0.1 to about 2.0 grams per liter with a more limited range of about 0.2 to about 0.5 grams per liter being preferred.

The amount of the condensate of the heterocyclic compound and epihalohydrin or the quaternary salt of such condensate utilized in the bath of this invention will in general be a function of the particular condensate or quaternized condensate employed as well as whether the bath is operated with or free of cyanides. Typically, however, when employing condensates of such heterocyclic compounds as nicotinamide and such epihalohydrins as epichlorohydrin, the quantity of the condensate or quaternized condensate in the bath should range from about 0.05 to about 1.0 grams per liter with a more limited range of from about 0.1 to about 0.5 grams per liter usually being preferred.

When the bath of this invention is operated in the presence of cyanide salts, such salts may include any of the salts or equivalent sources of cyanide ion conventionally used in zinc cyanide plating. Typically, such cyanide salt is an alkali metal cyanide such as sodium or potassium cyanide. The quantity of the cyanide salt present in the bath may range from about 2 to about 200 grams per liter with a more limited and lower range of from about 4 to about 40 grams per liter generally being preferred for most applications.

If desired, improved bath performance can be achieved through the addition of sodium carbonate, particularly during bath start up. Typically, amounts of sodium carbonate of from about 20 to about 120 grams per liter can be used, with the more limited range of 30 to 40 grams per liter being preferred.

The plating bath of this invention may contain other additives of the type conventionally employed in alkaline zinc electroplating baths and include such materials as brightening agents such as aldehydes, grain refiners such as polyamines, gelatin, glues, peptone or polyvinyl alcohols. Illustrative of such other additives are the organic aldehydes which contain a carbonyl group of aldehydes which contain a carbonyl group of aldehyde functionality which generally may be represented by the formula:

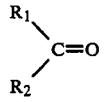

wherein $R_1$ and $R_2$ are alike or different and selected from the group consisting of hydrogen, alkyl of from generally 1 to about 10 carbon atoms, aryl and heterocyclic oxygen and sulfur containing radicals and include, for example, m-hydroxy benzaldehyde, p-hydroxy benzaldehyde, piperonal, o-hydroxy benzaldehyde, furfural, glyceraldehyde, anisaldehyde, vanillin and thiophene-2-aldehyde.

The aldehyde brighteners used in combination with the bath soluble polymer containing repeating tertiary and/or quaternary-aminoalkyl acrylamide groups of the present invention usually will be present in the bath within the ranges conventionally utilized for alkaline zinc plating baths. Typically, this will range from about 0.05 to about 5 grams per liter and preferably is from about 0.1 to 0.5 grams per liter.

Polyvinyl alcohol may also be suitably used in the bath of this invention especially to enhance the obtainment of a mirror-like finish for the electrodeposits. When so employed, these polyvinyl alcohols should be utilized in the bath within a range of from about 0.001 to about 0.5 grams per liter.

The electroplating of zinc conducted in accordance with the process of this invention is effected in conventional fashion basically by passing a direct current from a zinc anode through the aqueous alkaline bath of this invention, containing essentially the bath soluble polymer containing repeating tertiary and/or quaternary-aminoalkyl acrylamide groups, zinc ions, cyanide ions if used and other additives such as brighteners and grain refiners, to the desired cathode article which is to be electroplated with the zinc. This process may be conducted at a temperature of from about 10° to about 100° C. or more, typically about 15° to about 45° C. The current densities employed may range from above about 0 to about 200 amperes per square foot with a more limited range of from about 1.0 to about 120 amperes per square foot being satisfactory for most plating operations.

It will be appreciated that many modifications and variations of the invention as hereinbefore set forth may be made without departing from the spirit and scope thereof. Accordingly, only such limitations should be imposed as are indicated in the following claims.

I claim:

1. A bright zinc electroplating bath comprising an aqueous alkaline solution which includes a source of zinc ions and a bath soluble polymer containing repeating tertiaryaminoalkyl acrylamide groups or a quaternary salt thereof.

2. The bath of claim 1 wherein the bath soluble polymer has the following structural formula:

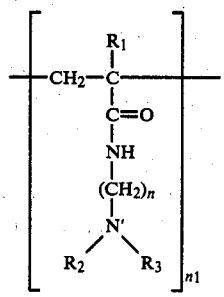

wherein $R_1$ is H or methyl; n is an integer from 2 to 6; $R_2$ and $R_3$ are alike or different and are lower alkyl groups containing 1 to 4 carbon atoms; and, $n_1$ is an integer of from about 3 to about 20.

3. The bath of claim 1 wherein the bath soluble polymer has the following structural formula:

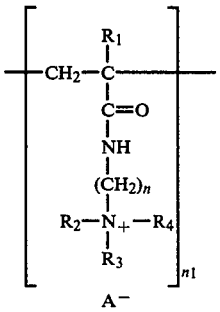

wherein $R_1$ is H or methyl, n is an integer from 2 to 6; $R_2$, $R_3$ and $R_4$ are alike or different and are lower alkyl groups containing 1 to 4 carbon atoms; $n_1$ is an integer of from about 3 to about 20; and A is halogen.

4. The bath of claim 3 wherein $R_1$, $R_2$, $R_3$ and $R_4$ are each methyl, n is 3 and $n_1$ about 10.

5. The bath of claim 1 wherein said bath soluble polymer is present in an amount of from about 0.05 to about 1.0 grams per liter.

6. The bath of claim 1 wherein said bath soluble polymer is present in an amount of from about 0.1 to about 0.2 grams per liter.

7. The bath of claim 1 wherein said bath contains a source of cyanide ions.

8. The bath of claim 1 wherein said bath is free of cyanide ions.

9. The bath of claim 1 wherein said bath contains a polyethylenepolyamine.

10. The bath of claim 9 wherein said polyethylenepolyamine is formed by the reaction of ammonia and ethylene dichloride.

11. The bath of claim 9 wherein said polyethylenepolyamine is present in an amount of from about 0.25 to about 5 grams per liter.

12. The bath of claim 9 wherein said polyethylenepolyamine is present in an amount of from about 0.3 to about 0.75 grams per liter.

13. The bath of claim 1 wherein said bath contains the condensate of a heterocyclic compound and an epihalohydrin or quaternary salt of such condensate.

14. The bath of claim 13 wherein the mol ratio of heterocyclic compound to epihalohydrin ranges from about 2:1 to 1:2, said condensate has a molecular weight of from about 400 to about 9,000, and said heterocyclic compound is a pyridine substituted in the 3 or 4 position with a radical selected from the group consisting of carbamoyl and acylhydrazino.

15. The bath of claim 13 wherein said heterocyclic is nicotinamide and said epihalohydrin is epichlorohydrin.

16. The bath of claim 13 wherein said condensate or quaternary salt thereof is present in an amount of from about 0.05 to about 1.0 grams per liter.

17. The bath of claim 13 wherein said condensate or quaternary salt thereof is present in an amount of from about 0.1 to about 0.5 grams per liter.

18. A process for electroplating zinc which comprises effecting the electroplating within the bath of claim 1.

19. The process of claim 18 wherein the plating is effected free of any cyanide ions.

20. The process of claim 18 wherein the plating is effected in the presence of cyanide ions.

21. An aqueous concentrate for preparing the bath of claim 1 which concentrate includes a bath soluble polymer containing repeating tertiary amino acrylamide groups or a quaternary salt thereof.

22. The aqueous concentrate of claim 21 which also includes a polyethylenepolyamine.

23. The aqueous concentrate of claim 21 which also includes a condensate of a heterocyclic compound and an epihalohydrin or quaternary salt of such condensate.

* * * * *